US006273536B1

(12) United States Patent
Nozawa

(10) Patent No.: US 6,273,536 B1
(45) Date of Patent: Aug. 14, 2001

(54) INK JET RECORDING APPARATUS

(75) Inventor: Minoru Nozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/342,190

(22) Filed: Jun. 29, 1999

(30) Foreign Application Priority Data

Jun. 30, 1998 (JP) ..... 10-184043

(51) Int. Cl.[7] ..... B41J 53/308; B41J 29/38; B41J 2/015

(52) U.S. Cl. ..... 347/8; 347/14; 347/21

(58) Field of Search ..... 347/8, 21, 106; 400/55

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,599,627 | 7/1986 | Vollert | 347/20 |
| 4,608,577 | 8/1986 | Hori . | |
| 4,723,129 | 2/1988 | Endo et al. | 347/56 |
| 4,740,796 | 4/1988 | Endo et al. | 347/56 |
| 5,366,301 | 11/1994 | Martin et al. | 400/56 |
| 5,398,049 | 3/1995 | Terasawa et al. | 347/8 |
| 5,852,452 * | 12/1998 | Imai | 347/8 |

FOREIGN PATENT DOCUMENTS

| | | | |
|---|---|---|---|
| 0 336 870 | 10/1989 | (EP) | B41J/25/30 |
| 0 516 283 | 12/1992 | (EP) | B41J/25/308 |
| 0 650 846 * | 5/1995 | (EP) | B41J/35/308 |
| 0 703 087 * | 3/1996 | (EP) | B41J/2/21 |
| 54-56847 | 5/1979 | (JP) | B41M/5/26 |
| 59-123670 | 7/1984 | (JP) | B41J/3/04 |
| 59-138461 | 8/1984 | (JP) | B41J/3/04 |
| 60-71260 | 4/1985 | (JP) | B41J/2/01 |
| 9-216354 | 8/1997 | (JP) | B41J/2/01 |

* cited by examiner

*Primary Examiner*—John Barlow
*Assistant Examiner*—Alfred Dudding
(74) *Attorney, Agent, or Firm*—Fitzpatrick, Cella, Harper & Scinto

(57) ABSTRACT

When recording is performed by using ink and a processing liquid for making a color material in the ink insoluble in a combined manner, a distance between a recording head and a sheet of paper is set to a larger value in a one-pass recording mode than in a multi-pass recording mode before the start of the recording. Also, when recording is performed on a film medium, the distance between the recording head and the sheet of paper is set to a smaller value than the case of using ordinary paper before the start of the recording.

9 Claims, 4 Drawing Sheets

INK JET RECORDING APPARATUS

BACKGROUND OF THE INVENTION

1. Field of the Invention

The present invention relates to an ink jet recording apparatus in which recording is performed by ejecting a recording liquid (referred to as ink hereinafter) from ink ejection orifices to fly in the form of droplets, and causing the ink to adhere onto a recording medium.

2. Description of the Related Art

In an ink jet recording system, an image is recorded by ejecting ink droplets from an ink jet recording head to a recording medium such as paper, a high image-quality recording medium (e.g., specific coated paper, calendered paper, or a calendered film), and an OHP film. Therefore, mists may occur due to fine ink droplets generated in addition to the ejected ink droplets, and a rebounding of the ink droplets ejected to impinge against the recording medium. Such mists may deposit on an ejection surface of the ink jet recording head. If a large amount of those ink droplets deposit around ejection orifices, or if foreign matters such as paper dust adhere to the deposited ink droplets, there arise problems of impairing the ink ejection and causing troubles including an undesirable deflection (a deviation of the ink droplets from the desired direction) and an ejection failure.

Particularly, when a gap between the ink jet recording head and the recording medium (referred to a head-to-paper gap hereinafter) is as narrow as not more than 1 mm, a large amount of the rebounding mist deposits around the ejection orifices.

In the ink jet recording system, the above problems are generally coped with by widening the head-to-paper gap to reduce the amount of the ink mists deposited, or wiping the ejection surface with a blade, which is formed of a rubber-like elastic member, to clean and remove the contaminations caused by the ink mists on the ejection surface.

Further, a recording medium which is extensible upon absorbing a large amount of ink, such as ordinary paper, accompanies a problem below. If the gap between the ink jet recording head and the recording medium is narrow, the head scratches the recording medium because the recording medium sags during high-duty recording due to a cockling thereof.

The above problem is also generally coped with by widening the head-to-paper gap. Widening the head-to-paper gap however increases the undesired deflection proportionally, thus resulting in a degradation of recording quality. Moreover, in an ink jet recording apparatus having a plurality of ink jet recording heads for color recording, registration of the heads (head alignment) is more apt to lose accuracy, which degrades recording quality and impairs color balance.

Meanwhile, recording is often made by using not only ink but also a treatment liquid for making a color material in the ink insoluble from the standpoints of improving water resistance and image quality. Although such a method is effective in improving water resistance and image quality, the ink made insoluble is gradually deposited at the orifices and thereabout in the ejection surface due to the aforesaid rebounding mist. Those deposits are hard to remove by the above-described wiping, preliminary ejection, or restoration by suction, and a serious ejection failure may occur.

Deposition of the ink made insoluble at the ejection orifices, etc. occurs primarily based on a phenomenon below. Ink droplets and a treatment liquid both ejected from an ink jet recording head rebound from a recording medium and are then deposited onto the ink jet recording head after being mixed together. Especially, if the ink droplets are ejected to an area to which the treatment liquid has been already ejected, the treatment liquid and the ink droplets may rebound and deposit onto the head in the form of an insoluble resulting from reaction between them.

Japanese Patent Laid-Open No. 9-216354 discloses an invention wherein a cover plate is provided to protect the ejection surface of an ink jet recording head in consideration of the nature and behavior of the rebounding mist generated upon ink and a treatment liquid impinging against a recording medium in an superimposed relation.

With the above related art, however, because the cover plate is provided between the ink jet recording head and the recording medium, the head-to-paper gap must be increased by an amount corresponding to a thickness of the cover plate, and recording quality degrades for the reasons mentioned above.

SUMMARY OF THE INVENTION

Objects of the present invention are therefore to achieve the following points:

1) To reduce deposition of an insoluble to ejection orifices caused by the rebounding mist when recording is made by using an ink jet recording head which ejects ink and a treatment liquid for making a color material in the ink insoluble.

2) To avoid the ink jet recording head from scratching the recording medium which sags due to cockling.

3) To suppress a degradation of image quality when a high image-quality recording medium is used.

To achieve the above objects, the present invention provides an ink jet recording apparatus in which recording is performed by ejecting ink from an ink ejection portion of a recording head, and causing the ink to adhere onto a recording medium, the recording apparatus comprising a control unit for changing a distance between the ink ejection portion and the recording medium depending on how the recording medium is apt to elongate in nature thereof upon application of the ink to the recording medium.

Also, the present invention provides an ink jet recording apparatus in which an ink ejection portion for ejecting ink and a processing liquid ejection portion for ejecting a processing liquid having an action to make a color material in the ink insoluble are employed to perform recording by selecting one of a first recording mode to make recording by ejecting the ink and the processing liquid onto a recording medium in an superimposed relation and a second recording mode to eject the ink but not the processing liquid onto the recording medium, the recording apparatus comprising a control unit for increasing a distance between the ink ejection portion and the recording medium to a larger value when recording is performed in the first recording mode than when recording is performed in the second recording mode.

With the above features, the distance between the ink ejection portion and the recording medium can be maintained at an appropriate value depending on the recording medium or the recording mode. Therefore, when recording is made by using the ink jet recording head which ejects the ink and the processing liquid for making the color material in the ink insoluble, deposition of an insoluble to ejection orifices caused by the rebounding mist can be reduced.

Also, the ink jet recording head can be kept from scratching the recording medium which sags due to cockling.

Further, in the case of using a high image-quality recording medium, the distance between the ink ejection portion and the recording medium can be set to be very narrow and better image quality than conventionally achieved can be ensured.

In the present invention, the processing liquid is a liquid having an action to improve printing properties. Here, an improvement of printing properties includes it to improve image quality such as represented by density, saturation, edge sharpness and dot size, to improve fixation of ink, to improve image preservation, i.e., weatherability such as resistance against water and light, and to suppress the occurrence of blur and white fog. Also, the processing liquid is a liquid that contributes to improving the printing properties, and is a liquid that contains a substance for making a color material in ink insoluble or agglomerated. Thus the treatment liquid includes a liquid for making a dye in the ink insoluble, a liquid capable of causing dispersion and disruption of a pigment in the ink, etc. The term "making a material insoluble" means such a phenomenon that an anionic group contained in the dye in the ink and a cationic group of a cationic substance contained in the liquid for improving the printing properties develop an ionic interaction to produce ionic bond, whereby the dye uniformly dispersed in the ink is separated from the solution. In the present invention, all the amount of the dye in the ink is not always required to be made insoluble, and even if so, it is possible to achieve advantages such as suppression of color bleeding, and improvements of coloring, character quality, and fixation of the ink which are intended by the present invention. Also, the term "agglomeration" is herein used as having the same meaning as the term "making a material insoluble" when a color agent for use in the ink is a water-soluble dye having an anionic group. When a color agent for use in the ink is a pigment, the term "agglomeration" includes such a phenomenon that a pigment dispersant or a pigment surface and a cationic group of a cationic substance contained in the liquid for improving the printing properties develop an ionic interaction, cause dispersion and disruption of the pigment, and then provides a much increase in particle size of the pigment. Usually, ink viscosity increases with the progress of the above-described agglomeration. Note that all the amount of the pigment or the pigment dispersant in the ink is not always required to be agglomerated, and even if so, it is possible to achieve advantages such as suppression of color bleeding, and improvements of coloring, character quality, and fixation of the ink which are intended by the present invention.

DESCRIPTION OF THE PREFERRED EMBODIMENT

A preferred embodiment of the present invention will be described below in detail with reference to the drawings.

Figure 1:
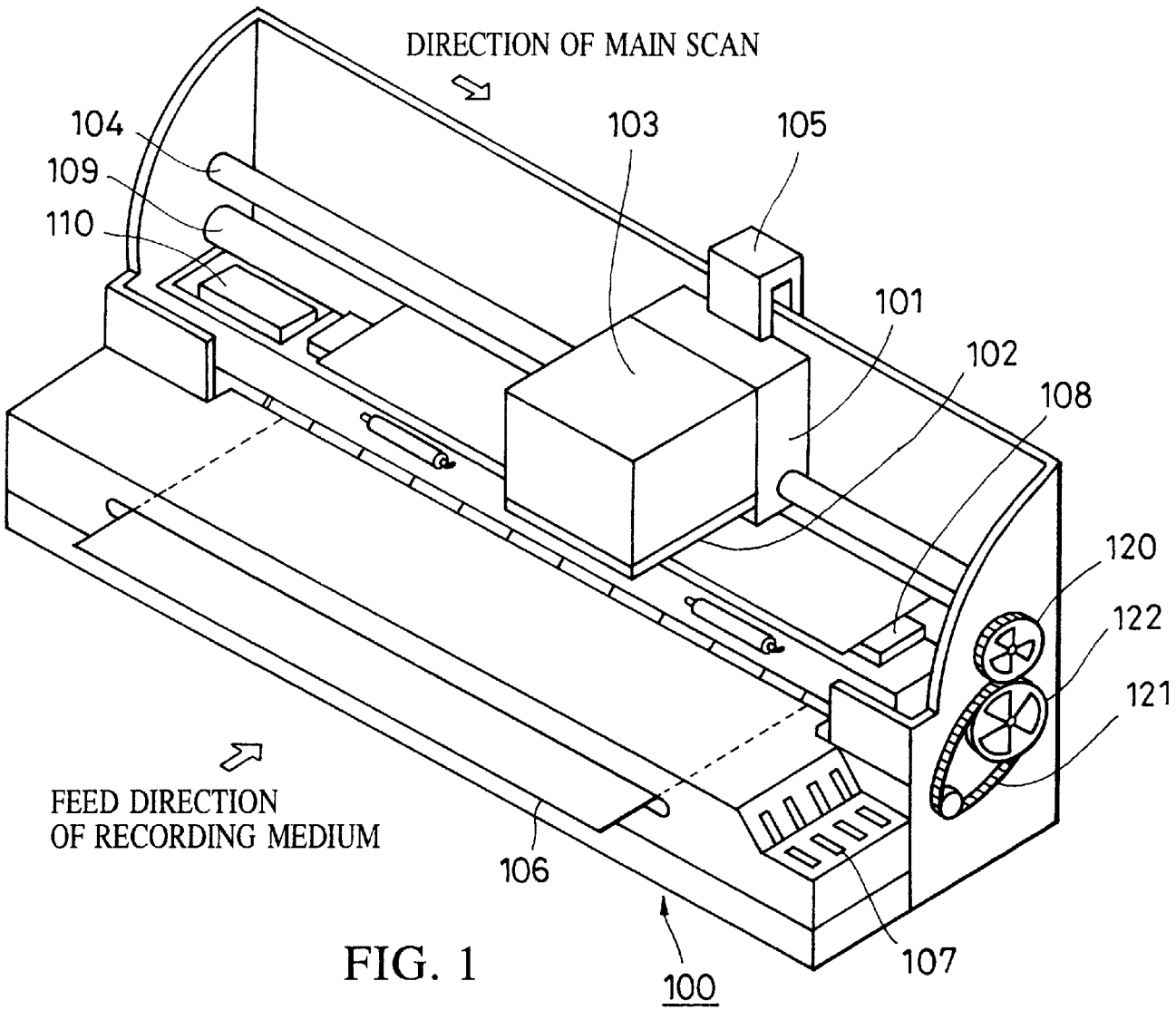
FIG. 1 is a perspective view showing an ink jet recording apparatus according to one embodiment of the present invention.

FIG. 1 is a perspective view schematically showing an ink jet recording apparatus 100 according to one embodiment of the present invention.

Referring to FIG. 1, a recording medium 106 set to a paper feed position in the recording apparatus 100 is advanced by a feed roller 109 to an area where printing can be made with an ink jet cartridge 103. A platen 108 is provided to position in contact with the back side of the recording medium in the printing-enable area.

A carriage 101 is constructed to be movable in a certain direction with cooperation of a guide shaft 104 and a guide unit 105. The movement of the carriage 101 renders the ink jet cartridge 103 to reciprocally scan over the printing-enable area in the direction of main scan. The carriage 101 mounts thereon the ink jet cartridge 103 which includes an ink jet head element capable of ejecting inks of multiple colors, an ink jet head element capable of ejecting a processing liquid reacting with the inks to make color materials in the inks insoluble, and ink tanks for supplying the inks and the treatment liquid to the corresponding elements of an ink jet head 102. The ejected inks can be of, e.g., four colors of black (Bk), cyan (C), magenta (M) and yellow (Y). In addition, a light ink having a color material concentration diluted to about ⅓ to ¼ of the densest can also be used for the purpose of realizing recording quality comparable to photographic image quality. A gray-scale image can be expressed by recording a pixel with the light ink ejected multiple times, or recording a pixel in combination of the light ink with a dark ink.

The guide shaft 104 is an eccentric shaft, and a gear 120 is attached to the guide shaft 104. By rotating the gear 120, the carriage 101 is forced to move up and down in accordance with the eccentricity of the guide shaft 104. The gear 120 is rotated by a head-to-paper gap control motor (not shown) through a transmission belt 121 and a gear 122.

At the left end of an area where the carriage 101 is movable, a restoration system unit 110 is provided below that area. The restoration system unit 110 can discharge the ink having increased viscosity from ejection orifices of the ink jet head at the start of recording, and can close the ejection orifices of the ink jet head by a cap member during a period of non-recording so that an ink solvent is kept from evaporating through the ejection orifices.

A control panel 107 comprises a switch section and an indicator section. The switch section is manipulated, for example, when turning on/off power of the ink jet recording apparatus, and setting various recording modes. The indicator section serves to indicate various status conditions of the recording apparatus.

Figure 2:
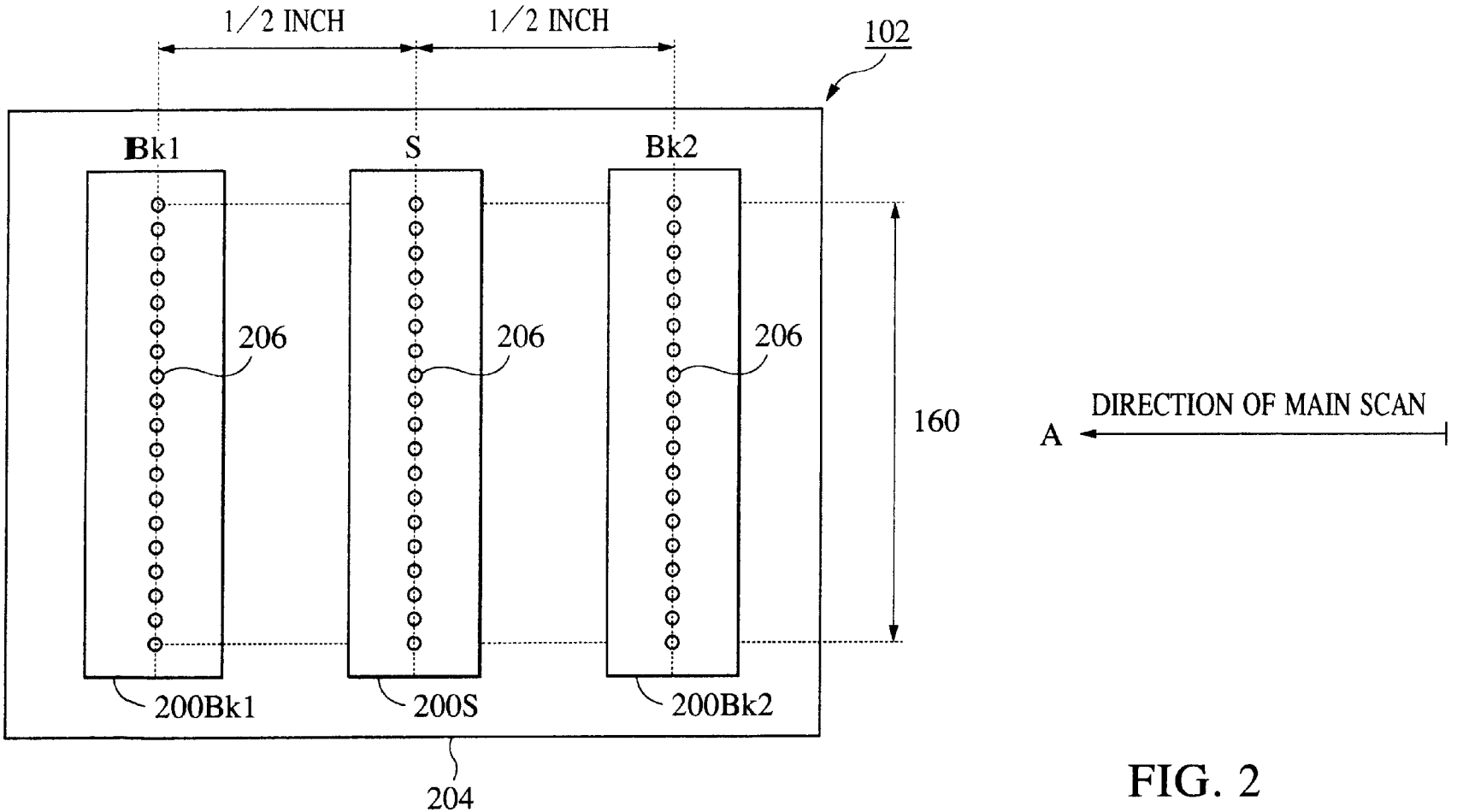
FIG. 2 shows an ejection surface of an ink jet recording head of the ink jet recording apparatus shown in FIG. 1.

FIG. 2 shows one example of an ejection surface of the ink jet head 102 constituting the ink jet cartridge 103 shown in FIG. 1.

The ink jet head 102 comprises two head elements 200Bk1 (nozzle line Bk1) and 200Bk2 (nozzle line Bk2) for ejecting a black ink K, and one head element 200S (nozzle line S) for ejecting a processing liquid S. Those head elements are arranged on a frame 204 with a ½-inch pitch in the direction of main scan.

The ink jet cartridge 103 thus constructed ejects the ink and the processing liquid in the order of Bk1-S-Bk2 for recording in the going direction, and in the order of Bk2-S-Bk1 for recording in the returning direction.

Figure 3:
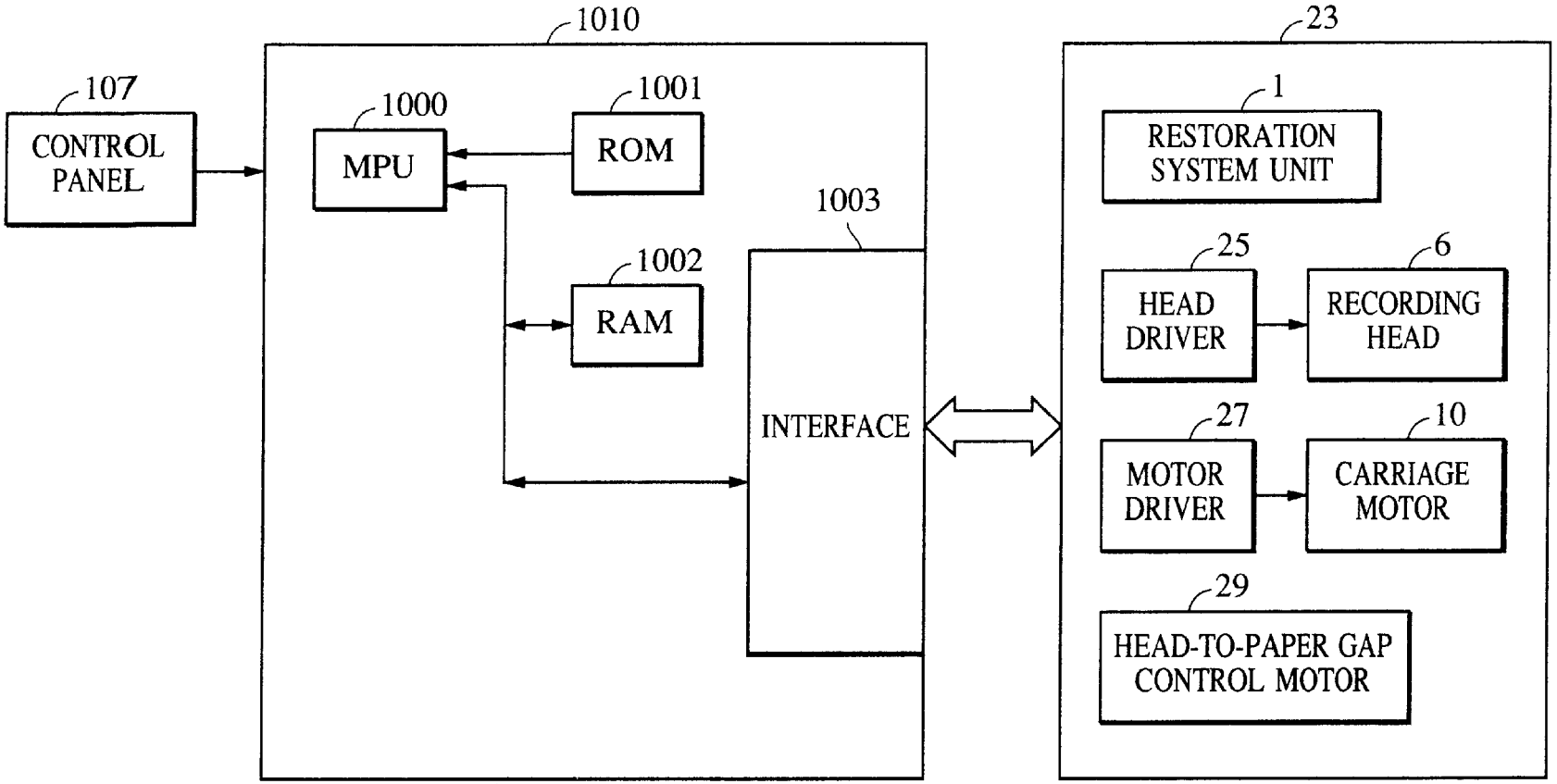
FIG. 3 is a block diagram showing one example of a control system for the ink jet recording apparatus of the present invention.

FIG. 3 is a block diagram showing one example of a control system for the ink jet recording apparatus having the above-described construction. Referring to FIG. 3, numeral 1010 denotes a control unit including control means for controlling a gap between the ejection surface of the recording head and the recording medium depending on the type of the recording medium, 1000 denotes an MPU for controlling various components, 1001 denotes a ROM for storing a program, etc. corresponding to control procedures executed by the MPU, and 1002 denotes a RAM serving as a work area for use in execution of the control procedures.

The control unit 1010 is connected to the control panel 107 and a printer unit 23 through an interface 1003. Control signals outputted from the control unit 1010 are used to drive a restoration system unit 1, a recording head 6 through a head driver 25, a carriage motor 10 through a motor driver 27, and a head-to-paper gap control motor 29.

Figure 4:
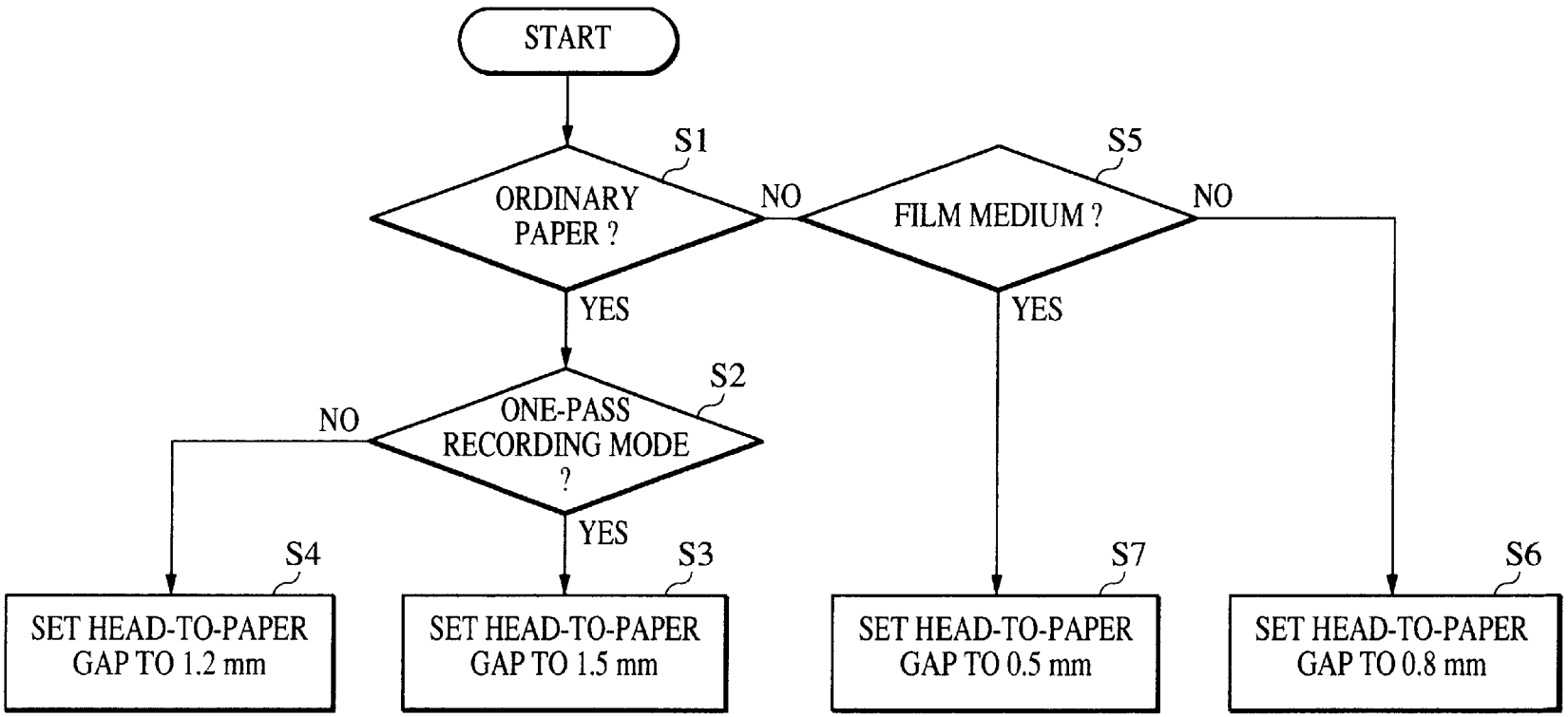
FIG. 4 is a flowchart showing steps for head-to-paper gap adjustment which are executed by the control system for the ink jet recording apparatus of the present invention.

FIG. 4 is a flowchart showing steps for head-to-paper gap control executed by the control unit 1010 shown in FIG. 3.

First, in step S1, it is determined whether a recording medium on which an image is to be recorded is ordinary paper or a specific high image-quality medium. It is here assumed that when the recording medium is ordinary paper, the ink and the processing liquid are used in a combined manner for recording. Also, when the recording medium is a specific high image-quality medium, the processing liquid is not used because an ink receptive layer or the like is formed on the side of the specific medium to which the ink is applied, so that the specific medium has satisfactory predetermined properties such as high water resistance and low ink blur without needing the combined use of the processing liquid. Thus, the step S1 determines whether the processing liquid is used or not.

Then, if it is determined in step S1 that the recording medium is ordinary paper, the control unit goes to step S2 to determine whether the mode is a one-pass recording mode for high-speed recording or a multi-pass recording mode for high-quality recording. Whether the recording is to be made in the one-pass recording mode or the multi-pass recording mode is set by an operator manipulating the control panel 107. If the mode is the one-pass recording mode, the control unit goes to step S3 in which the head-to-paper gap control motor 29 is driven to set the head-to-paper gap to 1.5 mm. Incidentally, the term "one-pass recording mode" means a mode of completing the recording by one main scan of the recording head, and the term "multi-pass recording mode" means a mode of performing the recording by several main scans of the recording head. In the multi-pass recording mode, the recording density per pass (main scan) is lower than that in the one-pass recording mode, and the rebounding mist of an insoluble is produced in a less amount. Therefore, if the mode is multi-pass recording mode, the control unit goes to step S4 where the head-to-paper gap can be somewhat narrowed and set to 1.2 mm. Stated otherwise, in the one-pass recording mode, the head-to-paper gap is increased to suppress an effect of the rebounding mist of an insoluble and to more surely keep the recording head from scratching the recording medium even with cockling of the medium. On the other hand, in the multi-pass recording mode, the head-to-paper gap is reduced so as to achieve recording of a high-quality image.

Next, if it is determined in step S1 that the recording medium is a specific high image-quality medium, the control unit goes to step S5. In step S5, it is determined whether the recording medium is a film medium such as a calendered film or an OHP film, or specific recording paper such as coated paper or calendered paper. For a film medium, the medium does not elongate upon application of the ink, and therefore hardly cockles. A sheet of specific recording paper cockles but in a smaller amount than ordinary paper. Thus, step S5 determines whether the recording medium is susceptible to cockling or not, i.e., whether the recording medium is apt to easily elongate or not upon application of the ink.

If it is determined in step S5 that the recording medium is a film medium (YES in step S5), the control unit goes to step S7 in which the head-to-paper gap control motor 29 is driven to adjust the head-to-paper gap to 0.5 mm. If the recording medium is specific recording paper (NO in step S5), the control unit goes to step S6 in which the head-to-paper gap is adjusted to 0.8 mm, taking into account cockling of the specific recording paper.

With the above steps, when a film medium is not used, the head-to-paper gap is increased to more surely keep the recording head from scratching the medium even with cockling of the medium. On the other hand, when a film medium is used, the head-to-paper gap is reduced so that the ink impinges against the medium with higher accuracy and an image is recorded with higher quality.

Generally, when a printer is used, the printer is connected to a personal computer and a recording mode is set by a printer driver built in the personal computer. It is therefore most desirable that the head-to-paper gap control be performed by determining on the printer side the type of a signal corresponding to the recording mode selected by the printer driver. For a printer capable of changing the recording mode upon manipulation of a switch section of a printer control panel as described above, however, the head-to-paper gap control is performed by a printer control unit which determines the recording mode selected through the switch section.

The present invention is particularly advantageous when applied, among various ink jet recording systems, to an ink jet recording head and apparatus of the type that flying ink droplets are formed by utilizing thermal energy to carry out recording.

The typical construction and principle of the above ink jet recording system are preferably based on the basic principles disclosed in, e.g., U.S. Pat. No. 4,723,129 and U.S. Pat. No. 4,740,796. The above recording system can be applied to any of the so-called on-demand and continuous type apparatus. Particularly, the on-demand type is more advantageous in that electro-thermal transducers are arranged corresponding to sheets and liquid passages holding a liquid (ink), and at least one driving signal which corresponds to recording information and provides such a quick temperature rise as exceeding a level required to cause seed boiling is applied to the electro-thermal transducer to generate thermal energy in the transducer, whereby film boiling is caused in a heat acting surface of a recording head so that a bubble can be formed in the liquid (ink) corresponding to the driving signal in one-to-one relation. With growth and shrinkage of the bubble, the liquid (ink) is ejected through an ejection orifice in the form of at least one droplet. More preferably, the driving signal is applied in the form of a pulse because using a pulse signal enables a bubble to properly grow and shrink in an instant, and can achieve ejection of the liquid (ink) superior especially in response.

The pulse-like driving signal is suitably produced as disclosed in U.S. Pat. No. 4,463,359 and U.S. Pat. No. 4,345,262. More superior recording can be achieved by employing the conditions for a temperature rising rate in the heat acting surface which are disclosed in U.S. Pat. No. 4,313,124.

The recording head can be constructed by combining ejection orifices, liquid passages, and electro-thermal transducers (to form linear or right-angled liquid passages) as disclosed in the above-cited US Patents. Alternatively, the recording head may be constructed such that the heat acting portion is arranged in a curved area, as disclosed in U.S. Pat. No. 4,558,333 and U.S. Pat. No. 4,459,600.

Further, a plurality of electro-thermal transducers can be constructed such that ejection orifices for the electro-thermal transducers are formed as a common slit, as disclosed in Japanese Patent Laid-Open No. 59-123670, or such that a hole for absorbing a pressure wave of thermal energy is formed corresponding to the ejection orifice, as disclosed in Japanese Patent Laid-Open No. 59-138461.

In addition, the recording head may be of the chip type that is replaceable to effect electrical connection to an apparatus main body and supply of ink therefrom when mounted to the apparatus main body, or of the cartridge type that an ink tank is provided integrally with the recording head itself.

Preferably, the recording head is provided with a restoration means, a preliminary auxiliary means, etc. from the standpoint of providing the advantages or the present invention with higher stability. Specifically, it is effective in achieving stable recording to provide a capping means, a cleaning means, a pressurizing or sucking means, and a preliminary heating means using the electro-thermal transducers or other heating elements or a combination thereof, and to perform a preliminary ejection mode to eject ink separately from recording.

Moreover, the recording apparatus can be constructed of an integral one recording head or a combination of plural recording heads to have at least one of recording modes such as a multi-color mode using inks of different colors and a full-color mode mixing inks of different colors. As an alternative, the recording apparatus may be constructed to have a recording mode using ink of only one color, e.g., black.

While the ink has been described as a liquid in the above embodiment of the present invention, the ink may be solidified at the room temperature or above, and then softened or liquefied at the room temperature. In other words, it is general in the above-described ink jet recording system to perform temperature control such that the temperature of ink itself is adjusted to fall in the range of 30° C. to 70° C. to hold the viscosity of the ink within an ejection stable range. The ink is therefore just required to be in a liquid state when a recording signal is applied to the head in use.

Additionally, the present invention can be also applied to the case of using ink having such a property as to liquefy only after application of thermal energy. For example, ink may be solidified when left standing from the standpoint of positively utilizing a temperature rise due to thermal energy as energy to cause a phase change from a solid state to a liquid state, or avoiding evaporation of the ink. In either case, the ink may be liquefied upon thermal energy being applied corresponding to a recording signal, and then ejected in a state of liquid ink, or the ink may have already started solidifying at the time of reaching a recording medium. Such ink may be held as a liquid or solid in recesses or through holes in a porous sheet, as disclosed in Japanese Patent Laid-Open No. 54-56847 or No. 60-71260, in an opposed relation to the electro-thermal transducers. When the present invention is applied to such ink, the most effective recording system is to implement ejection of the ink in accordance with the above-mentioned film boiling method.

According to the present invention, as described above in detail, when recording is made by using an ink jet recording head which ejects ink and a treatment liquid for making a color material in the ink insoluble, deposition of an insoluble to ejection orifices caused by the rebounding mist can be reduced. As a result, an ink jet recording apparatus capable of continuing recording with stable recording quality and high reliability can be provided.

It is also possible to solve a problem that the ink jet recording head may scratch a recording medium which sags due to cockling, the problem having been encountered during high-duty recording.

Further, in the case of using a high image-quality recording medium, the head-to-paper gap can be set to be very narrow and better image quality than conventionally achieved can be ensured.

What is claimed is:

1. An ink jet recording apparatus in which recording is performed by ejecting ink from an ink ejection portion of a recording head, and causing the ink to adhere onto a recording medium, said recording apparatus comprising:

control means for changing a distance between said ink ejection portion and said recording medium depending on how the recording medium is apt to elongate upon application of the ink to said recording medium.

2. An ink jet recording apparatus according to claim 1, wherein said control means performs control in accordance with a signal corresponding to a recording mode selected by a printer driver on the host side.

3. An ink jet recording apparatus according to claim 1, wherein said control means performs control in accordance with a signal corresponding to a recording mode selected by a switch on said ink jet recording apparatus.

4. An ink jet recording apparatus according to claim 1, wherein when wherein said recording medium is a first recording medium that is more apt to elongate upon application of the ink, said control means sets the distance between said ink ejection portion and said first recording medium to a larger value than when recording is performed on a second recording medium that is less apt to elongate upon application of the ink than said first recording medium.

5. An ink jet recording apparatus according to claim 1, wherein said ink ejection portion included a thermal energy generator for providing thermal energy to eject the ink.

6. An ink jet recording apparatus in which an ink ejection portion for ejecting ink and a processing liquid ejection portion for ejecting a processing liquid that makes a color material in the ink insoluble are employed to perform recording by selecting one of a first recording mode to make recording by ejecting the ink and the processing liquid onto a recording medium in a superimposed relation and a second recording mode to eject the ink but not the processing liquid onto said recording medium, said recording apparatus comprising:

control means for increasing a distance between said ink ejection portion and said recording medium to a larger value when recording is performed in said first recording mode than when recording is performed in said second recording mode.

7. An ink jet recording apparatus according to claim 6, wherein when recording is performed in said first recording mode, said control means sets the distance between said ink ejection portion and said recording medium to a smaller value in the case of recording an image by scanning a recording head plural times than the case of recording the same image by scanning said recording head once.

8. An ink jet recording apparatus according to claim 6, wherein when recording is performed in said second recording mode, said control means sets the distance between said ink ejection portion and said recording medium to a larger value in the case of said recording medium being a first recording medium, which is apt to elongate upon application of the ink, than the case of said recording medium being a second recording medium which is less apt to elongate upon application of the ink than said first recording medium.

9. An ink jet recording apparatus according to claim 6, wherein said ink ejection portion includes a thermal energy generator for providing thermal energy to eject the ink.

* * * * *

UNITED STATES PATENT AND TRADEMARK OFFICE

CERTIFICATE OF CORRECTION

PATENT NO. : 6,273,536 B1
DATED : August 14, 2001
INVENTOR(S) : Minoru Nozawa

It is certified that error appears in the above-identified patent and that said Letters Patent is hereby corrected as shown below:

Column 1,
Line 29, "to" should read -- to as --; and
Line 67, "etc." should read -- etc., --.

Column 2,
Line 13, "an" should read -- a --; and
Line 49, "an" should read -- a --.

Column 5,
Line 2, "etc." should read -- etc., --.

Column 7,
Line 14, "etc." should read -- etc., --.

Column 8,
Line 23, "wherein" (second occurrence) should be deleted; and
Line 31, "included" should read -- includes --.

Signed and Sealed this

Nineteenth Day of March, 2002

*Attest:*

*Attesting Officer*

JAMES E. ROGAN
*Director of the United States Patent and Trademark Office*